US005640712A

United States Patent [19]

Hansen et al.

[11] Patent Number: 5,640,712

[45] Date of Patent: Jun. 24, 1997

[54] BATTING GLOVE WITH SHIELD

[76] Inventors: Brian J. Hansen, 5717—21st Ave. South, Minneapolis, Minn. 55417; Stewart L. Hansen, 8305 West Bend Rd., Golden Valley, Minn. 55427

[21] Appl. No.: 444,060

[22] Filed: May 24, 1995

[51] Int. Cl.[6] ..... A41D 13/08

[52] U.S. Cl. ..... 2/20; 2/161.1; 2/16

[58] Field of Search ..... 2/16, 19, 20, 160, 2/161.1, 161.6, 162, 163, 167

[56] References Cited

U.S. PATENT DOCUMENTS

| | | | |
|---|---|---|---|
| D. 259,220 | 5/1981 | Small et al. . | |
| 241,224 | 5/1881 | Kleinert . | |
| 2,113,976 | 1/1938 | Nixon . | |
| 2,952,021 | 9/1960 | Finn . | |
| 3,189,919 | 6/1965 | Chase . | |
| 3,458,867 | 8/1969 | Moore et al. . | |
| 3,598,408 | 8/1971 | Klose . | |
| 3,994,024 | 11/1976 | Bates . | |
| 4,042,975 | 8/1977 | Elliot | 2/161.1 |
| 4,068,318 | 1/1978 | McMahon . | |
| 4,150,442 | 4/1979 | Boone . | |
| 4,272,850 | 6/1981 | Rule . | |
| 4,374,439 | 2/1983 | Norman . | |
| 4,411,024 | 10/1983 | Hayes | 2/161.1 |
| 4,484,361 | 11/1984 | Leighton et al. . | |
| 4,541,127 | 9/1985 | Gould . | |
| 4,700,405 | 10/1987 | Sternberg | 2/161.1 |
| 4,768,234 | 9/1988 | Yamamoto | 2/161.1 |
| 4,815,147 | 3/1989 | Gazzano et al. | 2/161.1 |
| 4,829,604 | 5/1989 | Allen et al. . | |
| 4,832,010 | 5/1989 | Lerman . | |
| 4,884,297 | 12/1989 | Triche . | |
| 4,891,845 | 1/1990 | Hayes . | |
| 4,896,378 | 1/1990 | Campana . | |
| 4,928,320 | 5/1990 | Aoki . | |
| 4,947,488 | 8/1990 | Ashinoff . | |
| 4,982,447 | 1/1991 | Henson . | |
| 5,067,175 | 11/1991 | Gold | 2/16 |
| 5,150,475 | 9/1992 | Hansen et al. . | |
| 5,329,638 | 7/1994 | Hansen et al. . | |

FOREIGN PATENT DOCUMENTS

| | | | |
|---|---|---|---|
| 2456289 | 6/1976 | Germany | 2/161.1 |

OTHER PUBLICATIONS

Gean WristGuard document.
Wrist Pro Wrist Protector label.
Drawing of Hansen Sports Wrist™Pro Wrist Protector.
Hansen Sports Wrist Pro Wrist Protector as shown in "Softball News", Apr. 1991.
Two page Hansen Sports Advertisement showing Hansen Sports Wrist Pro Wrist Protector.
Hansen Sports Wrist Pro Wrist Protector as shown in "Let's Play Softball", Jul. 4, 1991.
Neumann Tackified™Glove Co.—Neumann "The Sports Glove Specialists" (Publication dated believed to be 1993).
1993 Baseball/Softball—Markwort Sporting Goods Company (Publication).

*Primary Examiner*—C. D. Crowder
*Assistant Examiner*—Larry D. Worrell, Jr.
*Attorney, Agent, or Firm*—Palmatier, Sjoquist, Helget & Voigt, P.A.

[57] ABSTRACT

A protective batting glove having finger portions for covering the fingers and hand of an individual, the glove includes a cushioned shield engaged to the glove proximate to the back of the hand of the individual such that the shield is concealed to provide the appearance of a conventional unprotected batting glove.

32 Claims, 8 Drawing Sheets

BATTING GLOVE WITH SHIELD

BACKGROUND OF THE INVENTION

Individuals engaging in baseball or fast pitch softball recreational activities frequently are injured when struck by a ball. A common location for injury is the back of an individual's hand which may be struck by a ball during batting activities. The back of a hand is defined as the posterior or dorsal portion, or metacarpus region, which is opposite to the palm between the wrist or carpus and the phalanges or fingers. The back of an individual's hand may be delicate and easily injured.

No known batting glove exists which provides protection to the back of the hand of an individual either through the inclusion of a permanent or releasable shield designed for minimization of injuries while simultaneously providing the conventional or unprotected batting glove appearance. In addition, a protective batting glove including a resilient shield may significantly improve a batter's confidence, thereby escalating performance and enjoyment of a game or sports related activity.

SUMMARY OF THE INVENTION

A protective batting glove having finger portions for covering the fingers and hand of an individual, the glove includes a cushioned shield engaged to the glove proximate to the back of the hand of the individual such that the shield is concealed to provide the appearance of a conventional unprotective batting glove.

An object of the present invention is to provide a protective batting glove for an individual of relatively simple and inexpensive design, construction and operation, which is safe and which fulfills the intended purpose of protecting the back of a hand of an individual thereby minimizing fear of injury resulting from recreational activities.

Another object of the present invention is to provide a resilient and lightweight shield which may be either releasably or permanently affixed to the back of a batting glove at the discretion of an individual.

Still another object of the present invention is to provide a resilient shield attached to the back of a batting glove providing the appearance of a conventional, unprotective batting glove.

A feature of the present invention includes a resilient shield attached to the back of the batting glove used for protecting the hand of an individual from injury.

Another feature of the present invention is the provision of a cushioned shield which is moldable or pliable to comfortably conform to the shape of the back of a hand of an individual.

Still another feature of the present invention is the provision of a cushioned shield which may include holes for ventilation purposes.

Still another feature of the present invention is the releasable attachment of the shield to the batting glove permitting the shield to be removed from the batting glove upon completion of an individual's turn at bat.

An advantage of the present invention is the appearance of a conventional, unprotective batting glove, while providing a substantial degree of protection to an individual during batting activities.

DETAILED SPECIFICATION OF THE PREFERRED EMBODIMENT

One form of the invention is illustrated and described herein. In general, the protective batting glove is indicated by the numeral 10. The batting glove 10 may be worn over either hand of an individual, having reciprocal features as described herein. For convenience, applicant will describe features for a left-handed batting glove only. It should be noted that the elements are equally applicable and transferable to a right-handed batting glove at the discretion of an individual.

In general, the batting glove 10 includes a plurality of sheaths 12 adapted for receiving engagement of the fingers and thumb of a hand. The batting glove 10 is preferably formed of leather material as is known in the art. Alternatively, the batting glove 10 may be formed of any suitable material as desired by an individual without adversely affecting the features and attributes as described herein. The batting glove 10 is normally worn by an individual during recreational activities associated with either baseball or softball. An individual may elect to wear a batting glove 10 during play in the field as well as during the person's turn at bat. A batting glove worn in the field is normally used within a baseball glove providing some minimal degree of padding in conjunction with moisture absorbency. A typical batting glove 10 may include a Velcro® (a complementary hook and loop fastening material) fastener 14 for securing the glove about the wrist of an individual. Alternatively, the fastener 14 may include an integral elastic member to secure the batting glove 10 about the wrist of an individual. Additionally, the fastener 14 may include a snap as preferred by an athlete.

Figure 2:
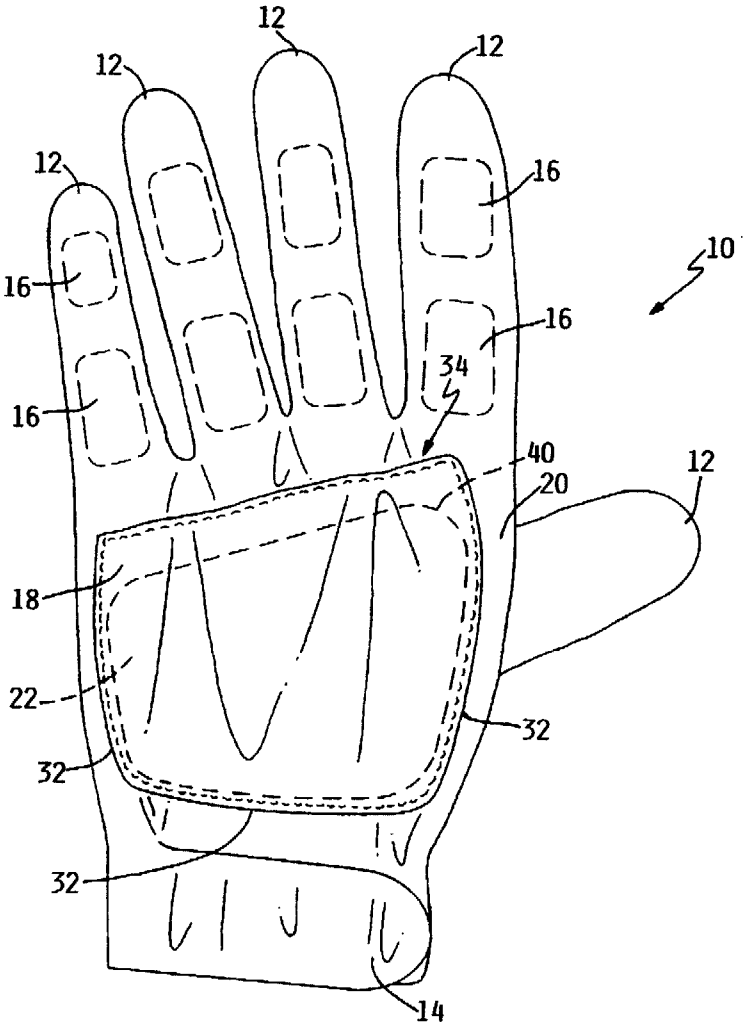
FIG. 2 is an alternate perspective view of the invention.
Figure 1:
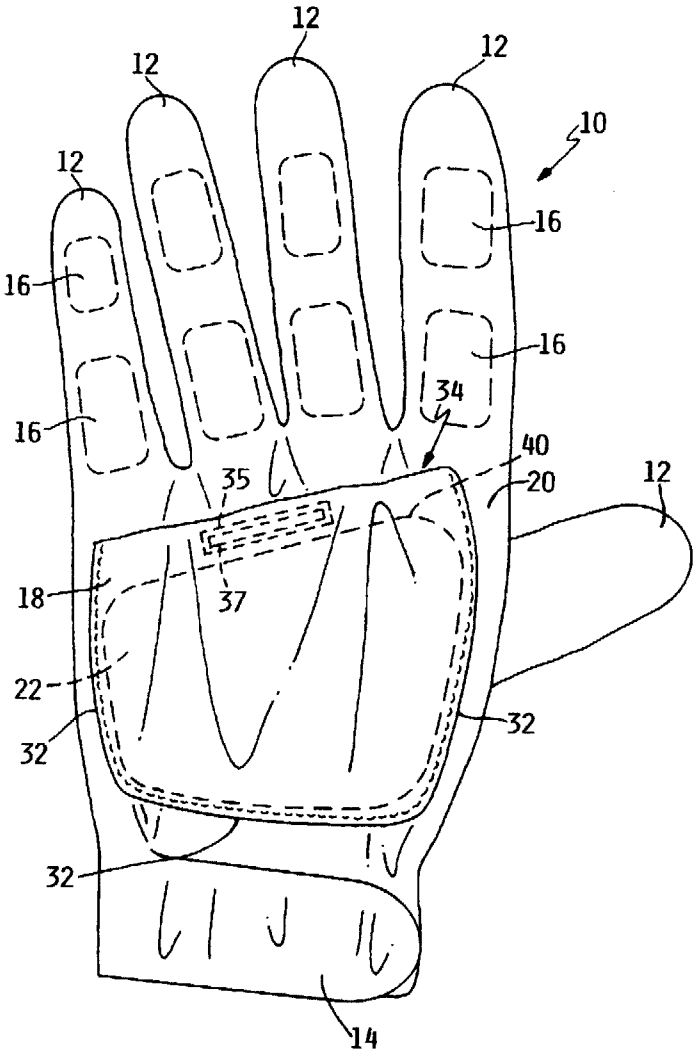
FIG. 1 is a perspective view of the invention.
Figure 3:
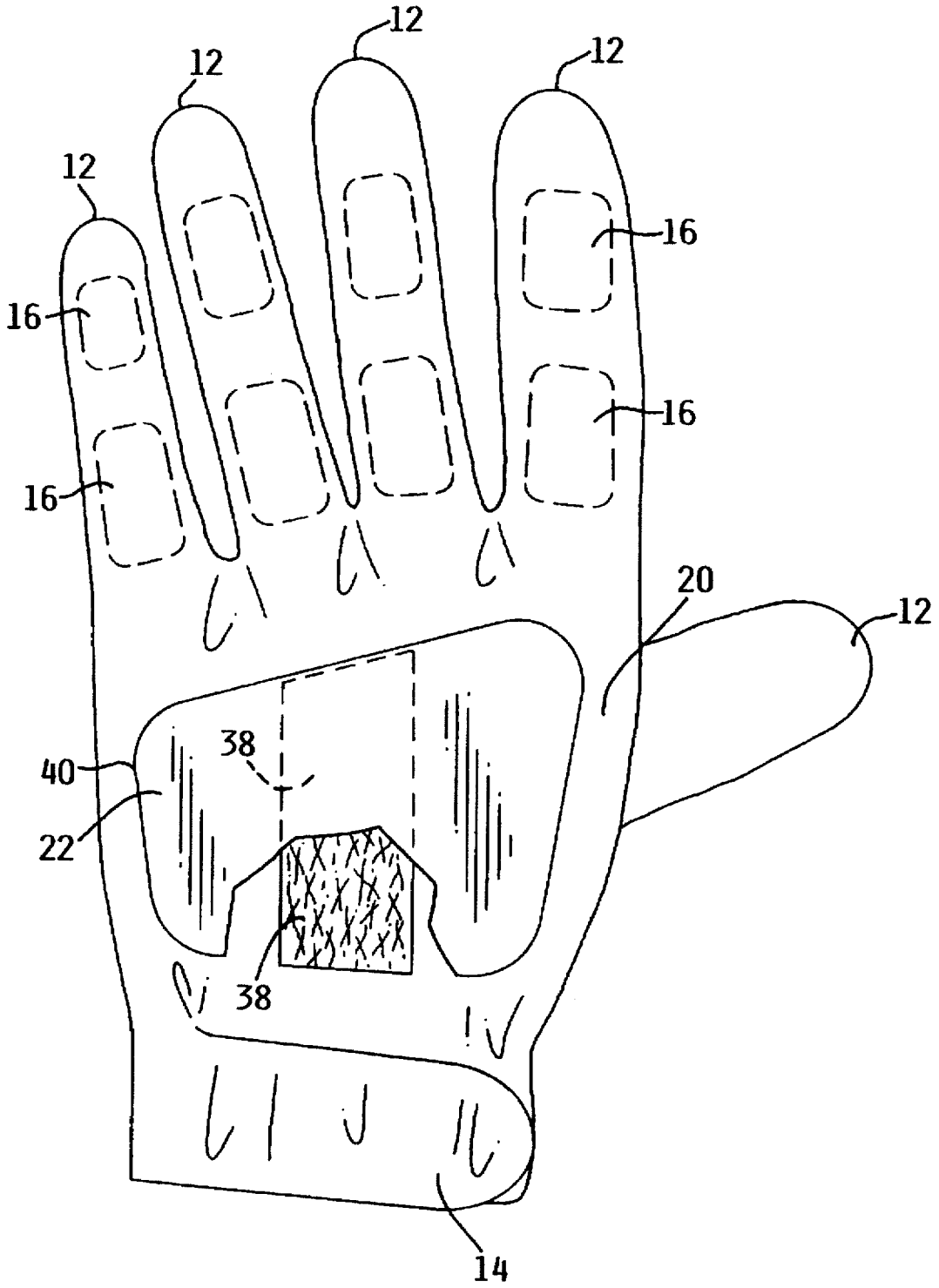
FIG. 3 is another alternate partial cutaway, partial phantom line view of the invention.

The protective batting glove 10 of the present invention may include padded finger portions 16. The padded finger portions 16 are preferably located on the posterior or dorsal portion of the first row and second row of phalanges or fingers of an individual as depicted in FIGS. 1–3. The location of the padded finger portions 16 adjacent the first and second row of phalanges, between the knuckle portions of an individual's fingers, permits flexibility and contraction of the athlete's fingers about a bat. It should be noted that the padded finger portions 16 do not adversely affect the grip of an individual about a bat. The padded finger portions 16 preferably function to provide some degree of protection to an individual's fingers thereby reducing injuries which may result from contact with a thrown baseball or softball during batting activities. In addition, an infielder may receive protection by using a batting glove including padded finger portions 16 during tagging activities of a base runner attempting to slide into a base.

The padded finger portions 16 are preferably formed of a resilient, substantially waterproof material and are also sufficiently heat resistant to permit cleaning by an individual. The padded finger portions 16 may be formed of a substantially integral, one-piece pad of a semi-rigid pliant material, or a multiple-piece pad at the discretion of an individual. One pliable material which may be utilized is HDPE-Polyethylene or gel. Such pliable material allows the padded finger portions 16 to be customized to fit the shape of an individual's fingers or the area of protection as desired. Alternatively, the padded finger portions 16 may be formed of any material as preferred by an individual including but not limited to cellular foam or gel of a density selected at the discretion of the athlete.

The batting glove 10 may include a pocket 18 fixed to the outer layer 20 which is adapted for housing a protective shield 22.

The pocket 18 is preferably positioned proximate to the back of the hand of an individual which is defined as the posterior or dorsal portion or metacarpus region which is opposite to the palm between the wrist and carpus and the phalanges or fingers.

The pocket 18 may be either permanently or releasably attached to the batting glove 10 by any means as preferred by an individual. In one embodiment, the pocket 18 may be sewn to the outer layer 20 by stitching to provide an outward appearance of a conventional, unprotective batting glove 10. (FIGS. 1–2) In an alternative embodiment, the pocket 18 may include sections of hook-type fasteners 24. Sections of loop-type fasteners 26 may be affixed to the outer layer 20 of the protective batting glove 10 for engagement to the hook-type fasteners 24 for releasable affixation of the pocket 18 to the outer layer 20. (FIG. 3) The hook-type fasteners 24 and the loop-type fasteners 26 may be material marketed under the trademark Velcro® (a complementary hook and loop fastening material). Alternatively, the pocket 18 may be attached to the batting glove 10 by a zipper.

The pocket 18 may be permanently affixed to the outer layer 20 by stitching, glue or other suitably affixation means at the discretion of an individual. Alternatively, the pocket 18 may be releasably affixed to the outer layer 20 by the use of sections of hook-type material 24 and mating sections of loop-type material 26, or straps, at the discretion of an individual.

The use of sections of hook-type material 24 and mating sections of loop-material 26 enable an athlete to disengage the pocket 18 from the outer layer 20 following the completion of an individual's turn at bat, permitting the athlete to place the pocket 20 including the protective shield 22 into a pocket. Alternatively, an athlete may transfer possession of the pocket 18 including the protective shield 22 to a base running coach.

The use of a pocket 18 which includes an opening 34 enables an individual to retract a protective shield 22 from the pocket 18 following completion of an individual's turn at bat. The athlete may then transfer the protective shield 22 to a pocket, or transfer possession of the protective shield 22 to a base running coach as preferred by the individual.

The pocket 18 may be substantially rectangular or square in shape and may include inner and outer sheets 28, 30 which are preferably affixed together by stitching along three of the four side portions 32 establishing the opening 34 which may be adapted for receiving engagement of the protective shield 22 within the interior of the pocket 18. Following the insertion of a protective shield 22, the opening 34 may be releasably closed by use of mating hook and loop material 35 and 37 respectively. Alternatively, the opening 34 may be secured by snaps or zippers at the discretion of an athlete.

The pocket 18 may be formed of a cotton or stretchable elastic, absorbent, and/or breathable fabric such as terry cloth or terry cloth-like material. Alternatively, the pocket 18 may be formed of a nylon or elastic nylon material or leather at the discretion of an individual. It should also be noted that the four side portions 32 of the pocket 18 may be permanently affixed to the outer layer 20 for permanently enclosing and affixing the protective shield 22 in a desired location on the batting glove 10. (FIG. 3)

The pocket 18 may be formed by stitching a one-piece portion of material or leather to the outer layer 20 of the protective batting glove 10. Alternatively, the pocket 18 may be formed by affixing an inner sheet 28 and outer sheet 30 together to form the pocket 18. The pocket 18 may then be affixed to the outer layer 20 by any means as preferred by an individual including but not limited to the use of sewing and/or mating sections of hook-type material 24 and loop-type material 26. It should be noted that the pocket 18 may be of the identical color as the batting glove 10 or alternatively may include any color or artistic marking as desired by an athlete. In addition, the pocket 18 may be used for the placement of a team logo or identification symbols as desired. The pocket 18 preferably provides the appearance of a conventional unprotected batting glove 10.

In an alternative embodiment, the pocket 18 may be absent from the protective batting glove 10 whereon the protective shield 22 may be permanently or releasably affixed directly to the outer layer 20. The protective shield 22 may be affixed to the outer layer 20 by any means as preferred by an individual including the use of stitching, spot stitching, and/or use of sections of hook-type material 36 and mating sections of loop-type material 38. It should be noted that the stitching or spot stitching of the protective shield 22 to the outer layer 20 preferably occurs about the periphery 40 of the protective shield 22.

The protective shield 22 may include a hard protective guard 42 and a cushion 44. Alternatively, the protective shield 22 may be formed of only the protective guard 42 or the cushion 44. The hard protective guard 42 may be formed of a semi-rigid, first closed cell foam. Alternatively, the hard protective guard 42 may be formed of any material as desired by an individual including the use of Kevlar, carbon composites, gels and/or plastics. The cushion 44 may be secured such as by gluing to the lower underlying surface of the hard protective guard 42. The cushion 44 may preferably be formed of a second closed cell foam to offer a greater cushioning effect to an individual than the hard protective guard 42, which may be of a greater hardness to receive the impact of a blow. In other words, the hard protective guard 42 includes a greater degree of stiffness than the cushion 44. This stiffness or firmness is believed to be controlled by the amount of cross linking agent in the foam.

The cushion 44 may be secured to the hard protective guard 42 to absorb the impact transmitted by a ball through the protective guard 42. The cushion 44 is approximately equal in width and length to the guard 42, but is typically slightly greater in thickness. The cushion 44 follows the curvature of the guard 42 and confronts either the inner sheet 28 of the pocket 18 or the outer layer 20 of the batting glove 10. The cushion 44 may be formed of a resilient, substantially waterproof closed cell foam material such that the batting glove 10 may be washable. The cushion 44 may also be sufficiently heat resistant to permit machine drying on a low heat cycle. It should be noted that the guard 42 and cushion 44 may be a substantially integral, one-piece shield 22 formed of a semi-rigid pliant material or a multiple piece shield. (FIG. 5) One pliable material which may be utilized is HDPE-polyethylene. Such pliable material allows the shield 22 to be customized to fit the unique shape of an individual's hand or the area of protection which is desired.

Figure 4:
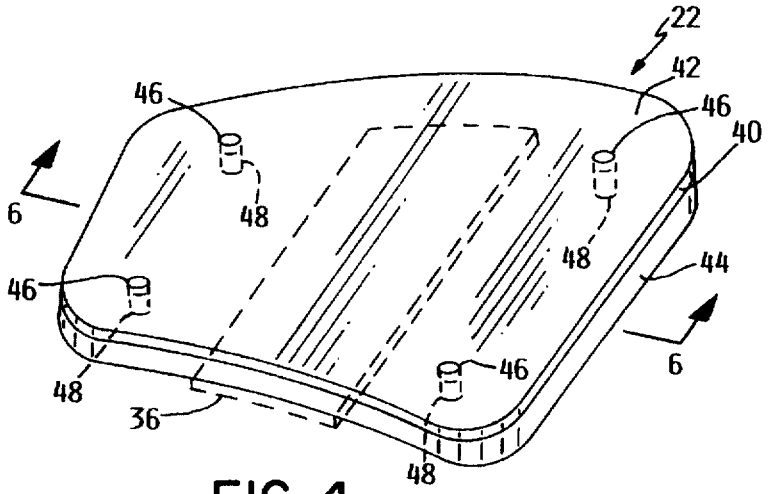
FIG. 4 is a detail view of the shield.
Figure 5:
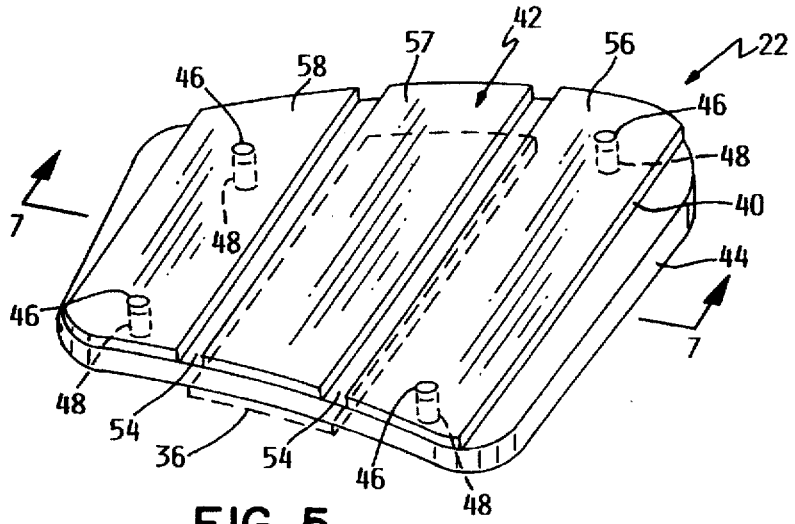
FIG. 5 is an alternate detail view of the shield.
Figure 6:
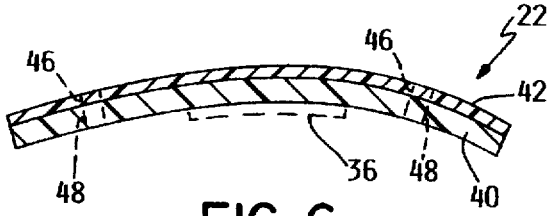
FIG. 6 is a cross-sectional side view of the shield taken along the line 6—6 of FIG. 4.
Figure 7:
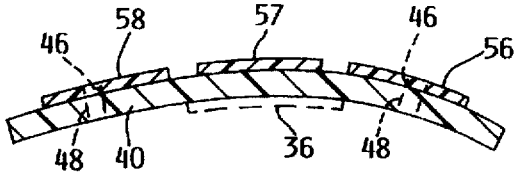
FIG. 7 is a cross-sectional side view of the shield taken along the line 7—7 of FIG. 5.
Figure 8:
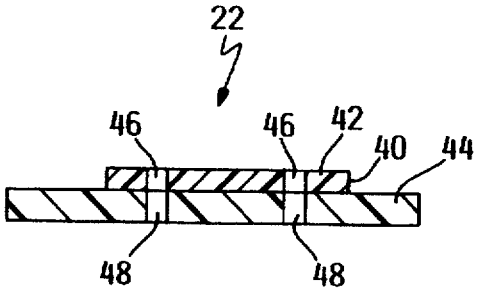
FIG. 8 is an alternative cross-sectional side view of the shield taken along the line of 6—6 of FIG. 4.
Figure 9:
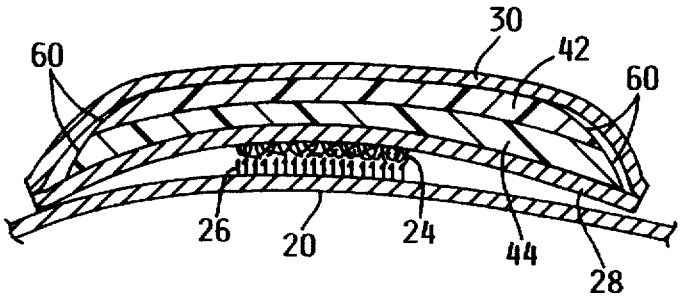
FIG. 9 is a cross-sectional side view of the invention taken along the line of 9—9 of FIG. 11.
Figure 10:
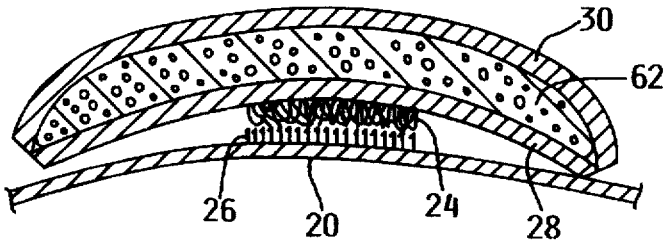
FIG. 10 is an alternate cross-sectional side view of the invention taken along the line of 9—9 of FIG. 11.

The protective shield 22 may be housed in the pocket 18 or may be directly attached to the outer layer 20, and may be formed of a hard, rigid, plastic-like material. The protective shield 22 may be rectangular in shape with rounded corners for minimizing puncture of the shield 22 through the pocket 18. The shield 22 may also include apertures 46 for ventilation. As shown in FIGS. 4 and 5, the shield 22 has a slight curvature with an outer face being convex and an inner face being concave such that the shield 22 somewhat follows the curvature of the back of an individual's hand. The protective shield 22 may be solid or may include channels 54 as depicted in FIG. 5. The material forming the shield 22 is preferably water resistant or waterproof to be machine washable, and heat resistant to be machine dryable.

The hard protective guard 42 preferably includes a periphery 40. The cushion 44 may extend to a position adjacent to the periphery 40, or may extend outwardly from the periphery 40 as desired by an individual.

When an object such as a baseball or softball strikes the protective batting glove 10, over the protective guard 42, it transmits a force that spreads out over the guard 42 and that is absorbed at least partially by the cushion 44. Hence, a lesser force is brought to bear on the back of an individual's hand.

The batting glove 10 when placed upon a hand absorbs perspiration. In particular, the outer layer 20 absorbs perspiration. It should be noted that the cushion 44 may include apertures 48 which are preferably adapted for alignment to the apertures 46 through the protective guard 42. The alignment of the apertures 46, 48 enables ventilation to occur through the protective shield 22 significantly increasing the comfort to an athlete.

In an alternative embodiment to the invention, snaps may be engaged to the outer layer 20 which are adapted for engagement to mating snaps affixed to the underside of the shield 22. Alternatively, a snap may be adapted for engagement to a mating snap affixed to the inner sheet 28 of the pocket 18, for attachment of the pocket 18 and shield 22 to the batting glove 10. The mating snaps may include recesses which are depressed relative to the cushion 44 to cooperate and secure the shield 22 and/or pocket 18 to the batting glove 10.

In an alternative embodiment as depicted in FIG. 5, the protective shield 22 may be formed of a multi-piece protective guard 42. Channels 54 indicate a longitudinal separation to define separate shield portions 56, 57, and 58. The separate shield portions 56, 57, and 58 may each be connected to an underlying cushion 44. Alternatively the separate shield portions 56, 57 and 58 may be either connected to each other or independent at the discretion of an individual. It should be noted that the separate shield portions 56, 57, and 58 are not required to include an underlying cushion 44. The multi-piece shield 22 may include a lateral channel of separations such that the separate shield portions 56, 57, and 58 are integral, permitting flexibility laterally and longitudinally during movement of an individual's hand. Likewise, the multi-piece shield 22 may additionally include only the lateral lines of separation such that the separate shield portions 56, 57, and 58 are independent and are positioned substantially perpendicular or parallel to the back of an individual's hand. These multi-piece separate shield portions 56, 57, and 58 may provide a more flexible, and hence more comfortable fit than a one-piece shield 22. It should be noted that the separate shield portions 56, 57, and 58 may be rigid or semi-rigid and may be affixed to the outer layer 20 by stitching between the separate shield portions.

It should be noted that the comers of the shield 22 are preferably rounded and may include, and be covered by, a strip of padding integral to the cushion 44 to protect the pocket 18 from wear and tear created by the protective guard 42 and its cushion 44. Such padding may be applied along the rounded comers or may extend about the entire peripheral edge 40 of the protective shield 22 at the discretion of an individual.

In another alternative embodiment of the invention, the pocket 18 may be absent and the shield 22 may be retained in place upon the outer layer 20 by stitching or spot stitching of the cushion 44 to the outer layer 20 exterior to the periphery 40 of the hard protective guard 42. Alternatively, the shield 22 may be affixed to the outer layer 20 by stitching or spot stitching of the hard protective guard 42 and underlying cushion 44 in a desired location upon the batting glove 10. If spot stitching is used by an individual, it is typically placed adjacent to the four comers of the protective shield 22 to maintain a substantially endless hollow interior. However, it should be noted that the stitching may extend about the entire periphery 40 of the shield 22. It should also be noted that such stitching, as it extends through the outer layer 20 and outer sheet 30 of the pocket 18, is typically the same color as the pocket 18 and batting glove 10 to maintain the appearance of a conventional, unprotective batting glove.

In an alternative embodiment, the cushion 44 of the shield 22 may extend outwardly from the peripheral edge 40 of the protective guard 42. Stitching may then occur through the cushion 44 and outer layer 20 to secure the shield 22 to the batting glove 10. The stitching may be positioned adjacent to the peripheral edge 40 of the protective guard 42.

In an alternative embodiment, the hard protective guard 42 may be formed of a semi-rigid first closed cell foam. This protective guard 42 may be secured such as by gluing to a lower underlying cushion 44 formed of a second closed cell foam to offer a greater cushioning effect than the upper hard protective guard 42, which is of a greater hardness to receive the impact of a blow. In other words, the protective guard 42 may include a greater degree of stiffness than the cushion 44. This stiffness or firmness is believed to be controlled by the amount of cross-linking agent in the respective foams. This protective shield 22 may be stitched at opposite ends to the outer layer 20 to secure the shield 22 in generally one place upon the batting glove 10. Alternatively, mating snaps as earlier described may be used to affix the protective shield 22 to the outer layer 20.

Figure 12:
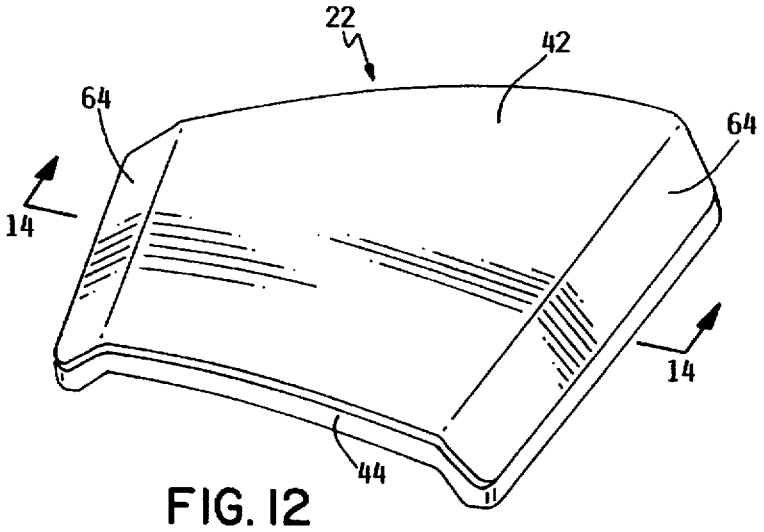
FIG. 12 is an alternative detailed view of the shield.
Figure 14:
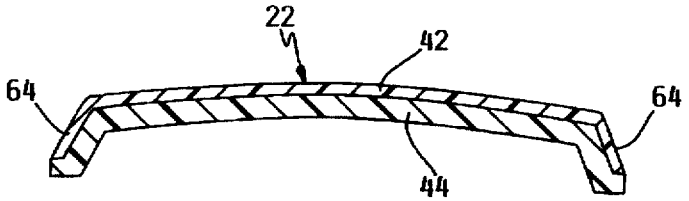
FIG. 14 is a cross-sectional side view of the shield taken along lines 14—14 of FIG. 12.

In an alternative embodiment of the invention as depicted in FIG. 12 and 14, the protective shield 22 may be bridge-shaped. In this embodiment, the protective shield 22 may be formed individually of a protective guard 42 having no underlying cushion 44. Alternatively, the protective shield 22 may be formed individually of a cushion 44 having no protective guard 42. In this embodiment, the protective shield 22 preferably includes a pair of downwardly diverging support wings 64 which preferably create an internal cavity between the protective shield 22 and the batting glove 10. The pair of downwardly diverging support wings 64 preferably are pliable and assist in the dispersement of force of a blow applied to the shield 22. It should be noted that the protective shield 22 in this embodiment may include apertures through the protective guard 42 and/or cushion 44. It should also be noted in this embodiment that the protective guard 42 may be formed of a semi-rigid closed cell foam. Alternatively, the protective guard 42 may be secured to the underlying cushion 44 to offer a greater cushioning effect upon exposure to a blow. In other words, the protective guard 42 may include a greater degree of stiffness than the cushion 44.

Figure 13:
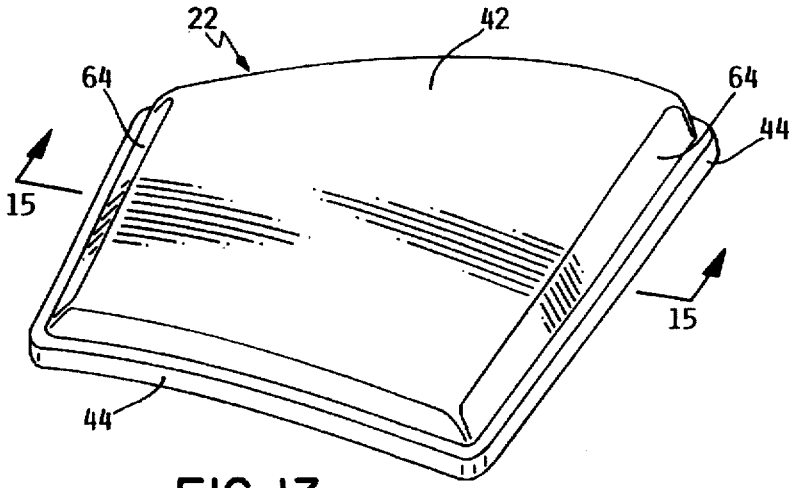
FIG. 13 is an alternative detailed view of the shield.
Figure 15:
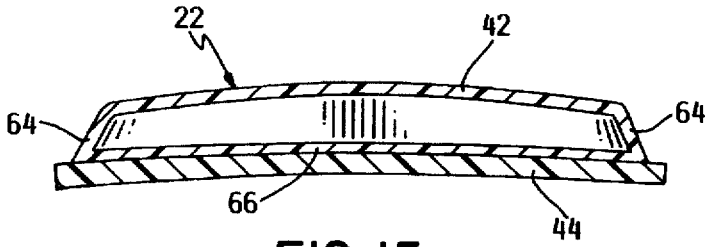
FIG. 15 is an alternative cross-sectional side view of the shield taken along lines 15—15 of FIG. 13.

In another alternative embodiment of the invention as depicted in FIGS. 13 and 15, the protective shield 22 may be pyramid-shaped. In this embodiment, the protective shield 22 may be formed individually of a protective guard 42 having no underlying cushion 44. Alternatively, the protective shield 22 may be formed individually of a cushion 44 having no protective guard 42. In this embodiment, the protective shield 22 preferably includes a pair of downwardly diverging support wings 64 and an underlying base 66 which preferably defines and internal cavity between the protective guard 42, downwarldy diverging support wings 64, and base 66. The pair of downwardly diverging support wings 64 preferably are pliable and assist in the dispersement of force of a blow applied to the shield 22. It should be noted that the protective shield 22 in this embodiment may include apertures through the protective guard 42, cushion 44, and/or base 66. It should also be noted in this embodiment that the protective guard 42 and base 66 may be formed of a semi-rigid closed cell foam. This protective guard 42 and base 46 may be secured to the underlying cushion 44 to offer a greater cushioning effect upon exposure to a blow. In other words, the protective guard 42 and base 66 may include a greater degree of stiffness than the cushion 44. It should also be noted that the cushion 44 in this embodiment may preferably be engaged only to the base 66 at the discretion of an individual.

Other materials that are flexible, bendable, and/or made of closed cell material and that resist water and that absorb shock may also be utilized for either the protective guard 42 or cushion 44. Such materials may include but are not limited to the use of foam or plastic materials. It should be noted that a hard plastic protector may be prohibited for use in some sport-related activities.

If desired the side edges of the protective guard 42 may be beveled as indicated by reference numeral 60, to provide a more sculptured look to the batting glove 10 as a whole.

Alternatively, the protective batting glove 10 may include a gel pack as a protective shield 22. The gel pack 62 includes a periphery of plastic (or fabric if desired) to be stitched to the outer layer 20. The gel pack 62 preferably includes a gel formed of a mixture of water and polyethylene glycol. The gel may also include gel agents such as Metacel, and bittering agents. The gel pack 62 serves a dual purpose. First, it may be utilized alone as a protective shield 22, or it may be substituted for the cushion 44 and protective guard 42 in FIGS. 4 and 5. Second, it may be cooled for use such as a cold pack to be placed over an injury such as a bruise sustained to the back of an individual's hand.

In an alternate embodiment of the invention, instead of including beveled edges 60, the upper stiffer layer of foam comprising the protective guard 42 may be of slightly reduced size as compared to the cushion 44 to provide a tapered look to the exterior of the pocket 18 or shield 22. In other words, at least the side edges of the protective guard 42 are spaced inwardly from the side edges of the less stiff cushion 44. If desired, the entire periphery 40 of the protective guard 42 may be spaced inwardly of the entire periphery of the cushion 44.

It should also be noted that the beveled effect may be provided on a one-piece shield 22 where the shield 22 is formed of a material which may be injected molded, such as closed cell foam.

The protective shield 22 may be permanently affixed to the outer layer 20 of the batting glove 10 by the use of glue, stitching, or any other suitable affixation means as desired by an individual. Alternatively, the protective shield 22 may be affixed to the outer layer 20 of the batting glove 10 by any releasable means as desired by an individual including but not limited to the use of snaps, sections of hook-type material 36 and corresponding mating sections of loop-type material 38 as desired by an individual. The protective shield 22 may include a team logo as desired by an athlete. The protective guard 42 may be solid or may include ventilation apertures 46 as preferred by an individual. A multi-piece protective guard 42 including separate shield portions 56, 57, and 58 may additionally include ventilation apertures 46 at the discretion of an individual. Alternatively, an athlete may prefer to have no ventilation apertures through the separate shield portions 56, 57 or 58. It should be noted that an athlete may desire to remove a protective shield 22 from the batting glove 10 during base-running activities. The releasable shield 22 may be then disengaged from the snaps, and/or hook and loop-type material 36, 38 for placement within an individual's pocket or for transfer of possession to a base running coach.

Figure 11:
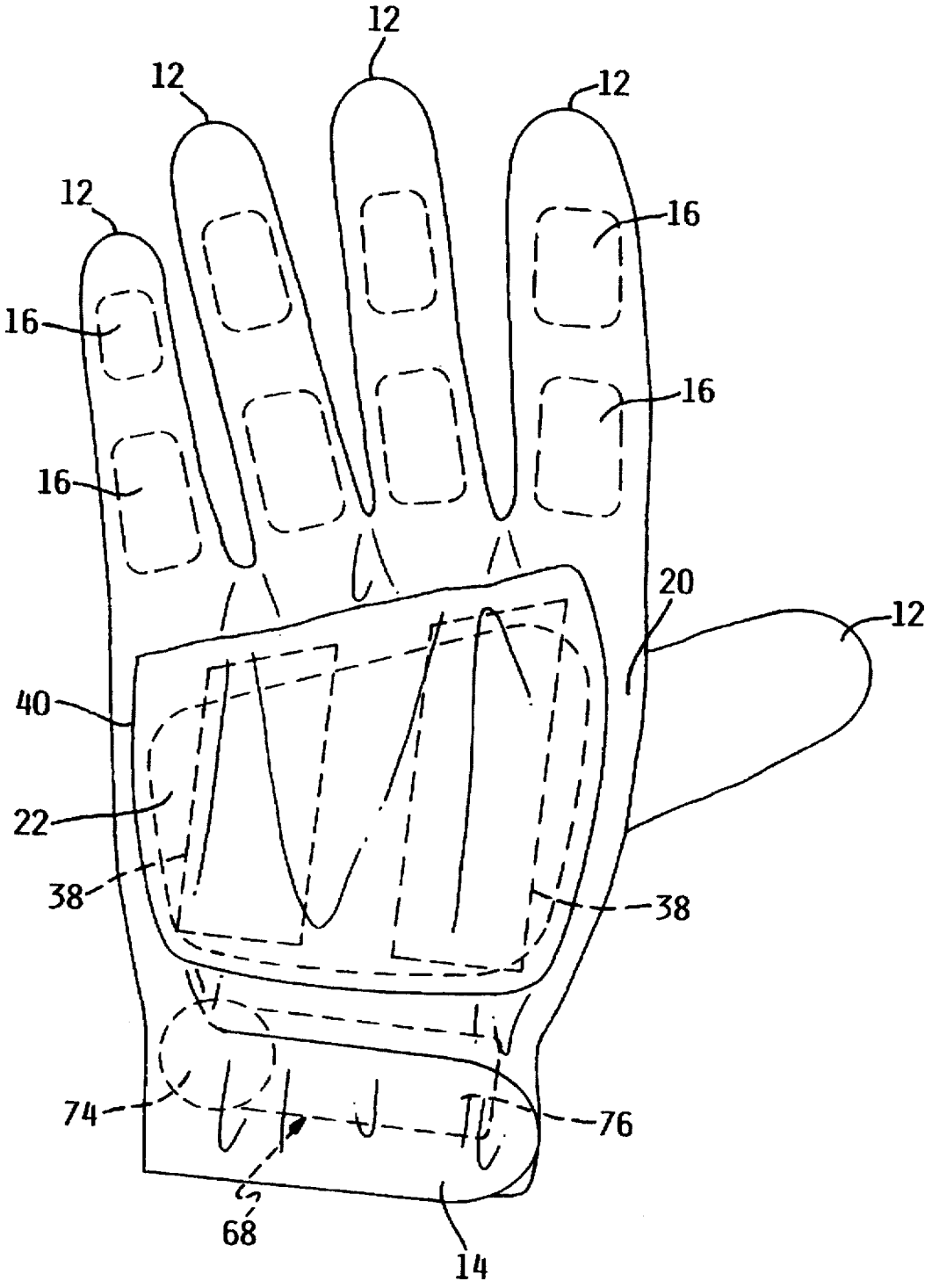
FIG. 11 is an alternate perspective view of the invention.

An alternative embodiment of the batting glove is depicted in FIG. 11. In this embodiment, a wrist shield 68 is provided in addition to the protective shield 22. The wrist shield 68 may preferably be located proximate to the fastener 14 and positioned over the pisiform or cuneiform portions of an individual's hand. The wrist shield 68 may either be rigid or pliable at the discretion of an individual and preferably does not interfere or restrict the motion of an individual's wrist during sporting activities. The wrist shield 68 may be formed of either a protective shield 70 or underlying cushion 72 at the discretion of an individual.

Figure 16:
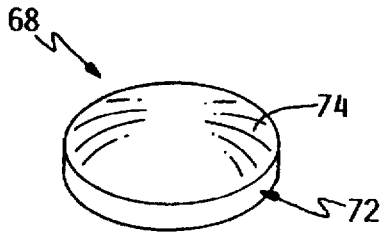
FIG. 16 is a detailed view of a wrist shield.

As depicted in FIGS. 16–22, the wrist shield 68 may be formed of a circular portion 74 or a strip portion 76. The circular portion 74 is preferably adapted for positioning over the pisiform or cuneiform bones of an individual's hand, protecting bruises which may occur to an individual during contact with a baseball or softball. As depicted in FIG. 16, the circular portion 74 is formed individually of an underlying cushion 72 and does not include a protective shield 70.

Figure 17:
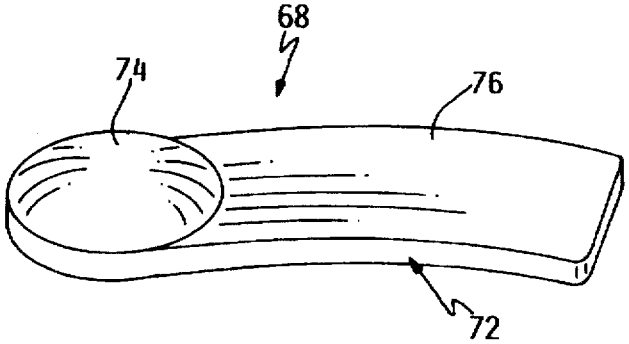
FIG. 17 is an alternative detailed view of a wrist shield.

As depicted in FIG. 17, the wrist shield 68 is formed of a circular portion 74 connected to a strip portion 76 which preferably extends across the entire width of the wrist of an individual. In this embodiment, the circular portion 74 and strip portion 76 are formed of underlying cushion 72 and do not include a protective shield 70.

Figure 18:
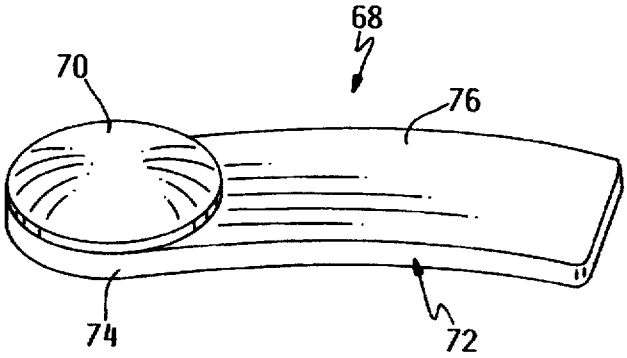
FIG. 18 is an alternative detailed view of a wrist shield.

As depicted in FIG. 18, the wrist shield 68 includes a circular portion 74 and strip portion 76. In this embodiment, the circular portion 74 is formed of an underlying cushion 72 and a protective shield 70 while the strip portion 76 is formed of an underlying cushion 72 having no protective shield 70.

Figure 19:
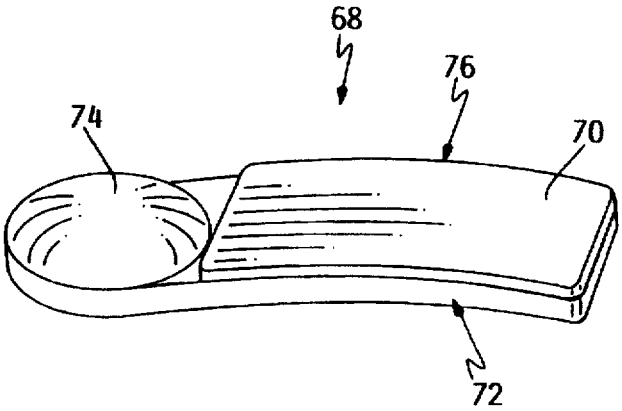
FIG. 19 is an alternative detailed view of a wrist shield.

As depicted in FIG. 19, the wrist protective 68 is formed of a circular portion 74 and strip portion 76. In this embodiment, the strip portion 76 is formed of a protective shield 70 and an underlying cushion 72 while the circular portion 74 is formed only of an underlying cushion 72.

Figure 20:
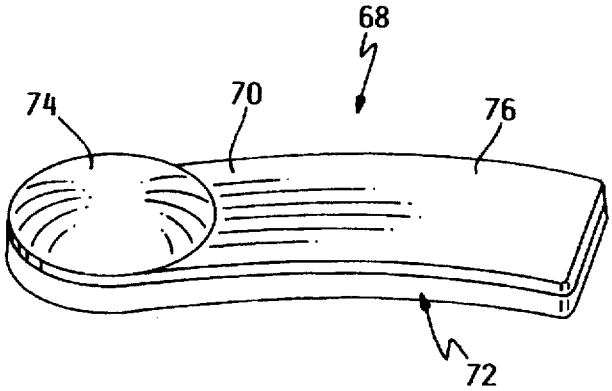
FIG. 20 is an alternative detailed view of a wrist shield.

As depicted in FIG. 20, the wrist shield 68 is formed of a circular portion 74 and a strip portion 76. In this embodiment, both the circular portion 74 and strip portion 76 include a protective shield 70 and underlying cushion 72.

Figure 21:
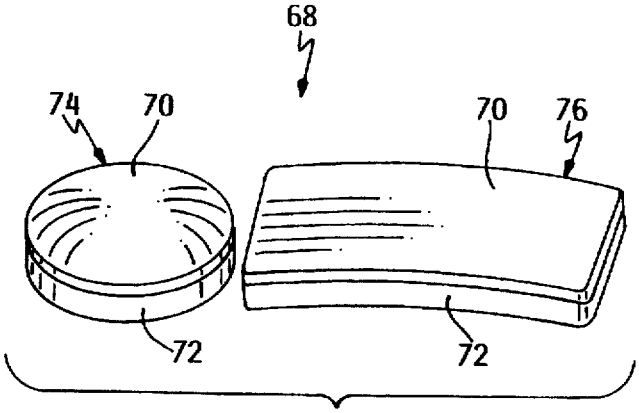
FIG. 21 is an alternative detailed view of a wrist shield.

As depicted in FIG. 21, the wrist shield 68 is formed of a circular portion 74 separated from a strip portion 76. In this embodiment, both the circular portion 74 and wrist portions 76 include a protective shield 70 and underlying cushion 72. In this embodiment, the circular portion 74 and wrist portion 76 are positioned adjacent to each other and proximate to the fastener 14 of a batting glove 10.

The wrist shield 68 may be integral to the batting glove 10 or may be releasably engaged thereto by the use of hook and loop fasteners such as Velcro® (a complementary hook and loop fastening material) as earlier described. Alternatively, the wrist shield 68 may be either permanently or releasably attached to a batting glove 10 within a pocket as earlier described. It should also be noted that the wrist shield 68 may be suitably eliminated from the batting glove 10 at the discretion of an individual.

Figure 22:
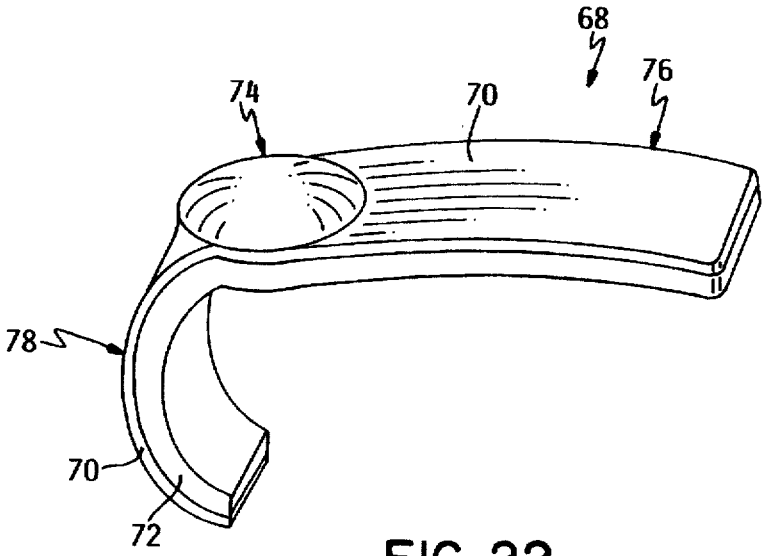
FIG. 22 is an alternative detailed view of a wrist shield.

As depicted in FIG. 22, the wrist shield 68 includes a strip portion 76, circular portion 74, and wraparound portion 78 which is curved to extend around the exterior portion of an individual's wrist. In this embodiment it should be noted that the wrist shield 68 may be formed of a substantially one-piece underlying cushion 72 or may be formed of independent and individual components at the discretion of an individual. In addition, it should be noted that the wrist shield 68 as depicted in FIG. 22 may be formed of any combination of protective shield and underlying cushion 72 for each of the components of the circular portion 74, strip portion 76, and wraparound portion 78 as desired by an individual. The wraparound portion 78 preferably assists in protecting the exterior edge of an individual's wrist from injury during batting activities.

The protective shield 70 and underlying cushion 72 of the wrist shield 68 are preferably formed of the same materials as earlier described for the protective shield 42 and cushion 44.

The present invention may be embodied in other specific forms without departing from the spirit or essential attributes thereof; and it is therefore desired that the present embodiment be consider in all respects as illustrative and not restrictive, reference being made to the appended claims rather than to the foregoing description to indicate the scope of the invention.

What is claimed:

1. A protective batting glove for protecting the back of the hand of an individual, comprising:

(a) a glove for covering the fingers and hand of an individual, said glove extending proximate to a wrist, said glove having an outer layer;

(b) a shield comprising a resilient portion integral to said outer layer proximate to said back of said hand, said shield including an edge and a flexible material extending proximate to said edge, said glove adapted to conceal said shield; and (c) a wrist shield comprising a circular portion on the glove, the circular portion positioned along an exterior edge of the wrist.

2. The invention according to claim 1, said outer layer further comprising a releasably closed pocket, the shield contained in the pocket.

3. The invention according to claim 1, wherein said shield is multi-pieced.

4. The invention according to claim 1, further comprising a plurality of padded portions on said glove for protecting the backs of said fingers.

5. The invention according to claim 1, wherein the wrist shield on said glove further comprises a strip portion for protecting the back of an individual's wrist.

6. A protective batting glove for protecting the back of the hand of an individual, comprising:

(a) a glove for covering the fingers and hand of an individual, said glove extending proximate to the wrist, said glove having an integrally connected outer layer; and (b) a bridge shaped shield comprising a resilient portion and a pair of support wings, the shield being concealed in said outer layer proximate to said back of said hand, said shield including an edge and a flexible material extending proximate to said edge, the pair of support wings on the resilient portion, the support wings diverging downwardly to bear against the back of the hand to create an internal cavity between the resilient portion and the back of the hand whereby the resilient portion flexes to absorb a shock of a blow.

7. A protective batting glove for protecting the back of a hand of an individual, comprising:

(a) a glove for covering the fingers and hand of an individual, said glove extending proximate to a wrist, said glove having an outer layer;

(b) a releasably closed pocket affixed to a portion of said outer layer, said pocket being centrally disposed between said wrist and said fingers proximate to the back of the hand of an individual;

(c) a shield comprising a resilient portion being concealed in said pocket, said shield including an edge and a flexible material extending proximate to said edge said shield having a plurality of apertures through the resilient portion and the flexible material to allow ventilation; and d) a wrist shield removably attached to the glove, the wrist shield comprising a flat portion for protecting the back of an individual's wrist and a circular portion for protecting an exterior edge of the wrist.

8. A protective batting glove for protecting the back of the hand of an individual, comprising:

(a) a glove for covering the fingers and hand of an individual, said glove extending proximate to a wrist, said glove having an outer layer;

(b) a releasably closed pocket affixed to a portion of said outer layer, said pocket being centrally disposed between said wrist and said fingers proximate to the back of the hand of an individual;

(c) a resilient shield being at least semi-rigid and having an underlying cushion, said resilient shield and cushion being entirely positioned within said pocket, said resilient shield and cushion having a width which is approximately equal to the width of the back of an individual's hand, said resilient shield and cushion being disposed inside said pocket such that said resilient shield and cushion are concealed; and d. a plurality of padded finger portions on the glove proximate to the fingers.

9. The invention of claim 8, wherein said resilient shield and cushion are attached so as to form one piece across the width of the back of an individual's hand.

10. The invention of claim 8, wherein said resilient shield comprises plastic.

11. The invention of claim 8, wherein said resilient shield comprises a pad having a greater degree of stiffness than the underlying cushion.

12. The invention according to claim 8, further comprising a wrist shield affixed to said glove comprising a strip portion for protecting the back of an individual's wrist and a circular portion for protecting an exterior edge of the wrist.

13. The invention of claim 12, wherein said cushion includes a greater periphery than said resilient shield to provide a tapered look to said pocket adjacent to said periphery and said wrist shield includes an underlying cushion between the wrist and each of the strip portion and circular portion.

14. A protective batting glove for protecting the back of the hand of an individual, comprising:

(a) a glove for covering the fingers and hand of an individual, said glove extending proximate to a wrist, said glove having an integrally connected outer layer;

(b) a closed pocket affixed to a portion of said outer layer, said pocket being centrally disposed between said wrist and said fingers proximate to said back of said hand of said individual; and (c) a resilient shield having a protective guard and an underlying cushion, said resilient shield being positioned within said pocket, said protective guard and cushion having a width which is approximately equal to the width of the back of an individual's hand, said protective guard and cushion attached so as to form one piece across the back of said individual's hand, said resilient shield being disposed in said pocket such that said protective guard and cushion are concealed, said protective guard having a plurality of diverging pliable support wings extending to a base to define an internal cavity between said protective guard and said base, the base on the cushion whereby said support wings and said internal cavity assist in absorbing a force of a blow to the glove.

15. A protective batting glove for protecting the back of the hand of an individual, comprising:

(a) a glove for covering the fingers and hand of an individual, said glove extending proximate to a wrist, said glove having outer layers;

(b) a closed pocket affixed to a portion of said outer layer, said pocket being centrally disposed between said wrist and said fingers proximate to the back of the hand of an individual;

(c) a resilient shield having an underlying cushion, said resilient shield and cushion being inserted into said pocket, said resilient shield and cushion having a width which is approximately equal to the width of the back of an individual's hand, said resilient shield comprising a pad having a greater degree of stiffness than said cushion, said resilient shield and cushion being disposed in said pocket such that said resilient shield and cushion are concealed; and (d) a wrist guard removably attached to the glove comprising a circular portion adjacent an exterior edge of the wrist.

16. The invention of claim 15, wherein said pad and cushion each comprise a closed cell foam of distinct density, the closed cell foam of said pad having a greater degree of stiffness and density than the closed cell foam of said cushion.

17. A protective batting glove for protecting the back of a hand of an individual, comprising:

(a) a glove for covering the fingers and hand of an individual, said glove extending proximate to a wrist, said glove having an outer layer, said glove further having a closed cavity being centrally disposed upon said outer layer between said wrist and said fingers proximate to the back of a hand of an individual; and (b) a resilient shield being at least semi-rigid and having a peripheral edge and an underlying cushion, a strip of padding on the peripheral edge, said resilient shield and cushion being disposed inside said cavity such that said resilient shield is concealed, stitching in the glove through the resilient shield to retain the resilient shield in the cavity.

18. A protective batting glove for protecting the back of a hand of an individual, comprising:

(a) a glove for covering the fingers and hand of an individual, said glove extending proximate to a wrist, said glove having an outer layer, said glove further having a cavity disposed on said outer layer, said cavity being centrally positioned between said wrist and said fingers proximate to the back of said hand of said individual;

(b) a pad disposed in said cavity, said pad having a width being approximately equal to the width of said cavity, said pad being disposed in said cavity such that such pad is concealed; and (c) a wrist shield on the glove having a strip portion covering the back of the wrist and a circular portion covering the exterior edge of the wrist, said strip portion comprising a protective shield and an underlying cushion between the protective shield and the wrist, the circular portion comprising a circular protective shield and an underlying cushion between the protective shield and the exterior edge of the wrist.

19. The invention of claim 18, wherein said pad comprises a gel.

20. The invention of claim 18, wherein said pad includes beveled side edges tapering outwardly from an upper surface of said pad to a lower surface of said pad.

21. The invention of claim 20, wherein said pad further includes additional beveled edges between said side edges, said additional beveled edges tapering outwardly from said upper surface of said pad to said lower surface of said pad.

22. The invention of claim 18, wherein said pad includes two portions, one of said portions confronting said hand, the other portion having a lesser periphery than said portion confronting said hand whereby said glove tapers about said periphery.

23. A protective batting glove for protecting the back of the hand of an individual, comprising:

(a) a glove for covering the fingers and hand of an individual, said glove extending proximate to a wrist, said glove having an outer layer;

(b) a closed pocket affixed to a portion of said outer layer, said pocket being centrally disposed between said wrist and said fingers proximate to the back of said hand of said individual;

(c) a resilient multi-piece shield being having an underlying cushion, said resilient multi-piece shield and cushion being positioned within said pocket, said resilient multi-piece shield and cushion being disposed inside said pocket such that said resilient multi-pieced shield and cushion are concealed;

(d) padded finger portion on each of the fingers, each padded finger portion; and e) a wrist shield on the glove having a circular portion proximate to an exterior edge of the wrist.

24. A protective batting glove for protecting the back of a hand of an individual, comprising:

(a) a glove for covering the fingers and hand of an individual, said glove extending proximate to a wrist, said glove having an outer layer, said glove further having a cavity disposed on said outer layer, said cavity being centrally positioned between said wrist and said fingers proximate to the back of said hand of said individual;

(b) a shield being at least semi-rigid and having a protective guard having a plurality of longitudinal channels and a peripheral edge with rounded corners and an underlying cushion, the shield including at least one hole extending through the protective guard and the cushion for ventilation, a pad on the peripheral edge of the protective guard, the shield and cushion being disposed in said cavity such that the shield is concealed; and (c) a wrist guard on the glove having a circular portion proximate to an exterior edge of the wrist and a strip portion proximate to a back of the wrist.

25. The invention according to claim 2, wherein said pocket is centrally disposed between said wrist and said fingers proximate to the back of said hand of said individual.

26. A protective batting glove for protecting the back of the hand of an individual, comprising:

(a) a glove for covering the fingers and hand of an individual, said glove extending proximate to a wrist, said glove having an outer layer;

(b) a shield being at least semi-rigid engaged to said outer layer proximate to said back of said hand, said shield having an underlying cushion, said shield including at least one hole and the cushion having an aperture aligned with the hole for ventilation, the shield and cushion being retained in generally one place such that the shield is concealed; and (c) a wrist shield on the glove comprising a wrap around portion extending from the exterior portion of an individual's wrist to the back of the wrist, a circular portion on the wrap around portion proximate to the exterior edge of the wrist.

27. The invention according to claim 26 further comprising at least one first snap affixed to said outer layer, and at least one second snap affixed to said shield for integral mating attachment to said first snap for affixation of said shield to said glove.

28. The invention according to claim 26 further comprising at least one portion of hook or loop material affixed to said outer layer, and at least one portion of mating hook or loop material affixed to said shield for integral mating attachment of said shield to said glove.

29. The invention according to claim 26 further comprising a plurality of pad sections affixed to said finger portions proximate to the back of the fingers.

30. The invention according to claim 26 further comprising a plurality of pad sections integral to said finger portions proximate to the back of the fingers.

31. The invention according to claim 26 further comprising stitching in the shield and the glove for retaining the shield in place on the glove.

32. The invention of claim 22, the shield further comprising a pair of downwardly diverging support wings, said downwardly diverging support wings engaging the cushion to form a cavity between the wings.

* * * * *

UNITED STATES PATENT AND TRADEMARK OFFICE

CERTIFICATE OF CORRECTION

PATENT NO. : 5,640,712

DATED : June 24, 1997

INVENTOR(S) : Hansen, et. al.

It is certified that error appears in the above-indentified patent and that said Letters Patent is hereby corrected as shown below:

Column 2, line 52, after the term "herein." and before the term "The", insert a paragraph break.

Column 6, line 24, delete "comers" and insert --corners--.

Column 6, line 29, delete "comers" and insert --corners--.

Signed and Sealed this

Twenty-third Day of September, 1997

*Attest:*

*Attesting Officer*

Bruce Lehman

BRUCE LEHMAN

*Commissioner of Patents and Trademarks*